US005190577A

United States Patent [19]

Bermel et al.

[11] Patent Number: 5,190,577

[45] Date of Patent: Mar. 2, 1993

[54] REPLACEMENT OF ARGON WITH CARBON DIOXIDE IN A REACTOR CONTAINING MOLTEN METAL FOR THE PURPOSE OF REFINING MOLTEN METAL

[75] Inventors: Curtis L. Bermel, Chicago; Sara H. Anderson; Daniel R. Urban, both of Westmont, all of Ill.

[73] Assignee: Liquid Air Corporation, Walnut Creek, Calif.

[21] Appl. No.: 625,955

[22] Filed: Dec. 11, 1990

[51] Int. Cl.[5] ..... C21C 5/35

[52] U.S. Cl. ..... 75/552; 75/559; 75/626; 75/628

[58] Field of Search ..... 75/548, 550, 552, 557, 75/559, 626, 628

[56] References Cited

U.S. PATENT DOCUMENTS

Re. 29,584 3/1978 Heise et al. ..... 75/548
4,280,838 7/1981 Mayu Kawa et al. ..... 75/552
4,474,605 10/1984 Masuda et al. ..... 75/552
5,051,127 9/1991 Hardie et al. ..... 75/555

FOREIGN PATENT DOCUMENTS 638621 12/1978 U.S.S.R. ..... 75/557

OTHER PUBLICATIONS

Anderson, et al. "Cost and Quality Effectiveness of Carbon Dioxide in Steelmills." Electric furnace conference proceedings. pp. 125-146. (1988).

Fruehan. "Reaction Model for the AOD Process," Ironmaking and Steelmaking. No. 3. pp. 153-158. (1976).

*Primary Examiner*—Melvyn J. Andrews
*Attorney, Agent, or Firm*—Curtis, Morris & Safford

[57] ABSTRACT

In a method for decarburizing metals and alloys, a two-gas component mixture consisting only of oxygen and carbon dioxide is introduced into molten metals or alloys at least during the first decarburization phase.

8 Claims, 8 Drawing Sheets

REPLACEMENT OF ARGON WITH CARBON DIOXIDE IN A REACTOR CONTAINING MOLTEN METAL FOR THE PURPOSE OF REFINING MOLTEN METAL

FIELD OF THE INVENTION

The present invention relates to the use of carbon dioxide in refining molten metals or alloys. In particular, a two-gas component mixture consisting only of oxygen and carbon dioxide is introduced into the molten metals or alloys at least during the first decarburization phase.

BACKGROUND OF THE INVENTION

This invention relates, in general, to a method for refining molten metals or alloys. Specifically, the invention relates to the particular step of decarburizing metals or alloys, especially stainless steel, carbon steel, low carbon steel, iron, nickel and cobalt based alloys.

It is known from the work of Savard et al., U.S. Pat. No. 2,855,298, that injection of gases, through a tuyere, below the surface of a molten metal in a containing vessel is one method for refining the molten metal. In particular this method is used for refining iron, steel, stainless steel and zinc. The method uses high pressure oxygen, which has a localized cooling effect on the submerged tuyere, to penetrate the bath and affect decarburization.

Nelson et al., U.S. Pat. No. 3,046,107, and later, Krivsky, U.S. Pat. No. 3,252,790, introduced methods for decarburizing metal baths, without substantial loss of chromium. These methods are known as the argon-oxygen decarburization "AOD" process. The "AOD" process was developed because molten stainless steels containing desirable amounts of chromium could not be decarburized without severe oxidation of the chromium. In the "AOD" process, a molten metal is decarburized by subsurface blowing with an inert gas-oxygen mixture. The presence of the inert gas, usually argon, reduces the partial pressure of carbon monoxide formation in the ga in contact with the metal. This operation results in the oxidation, and thus removal, of carbon preferentially to the oxidation of chrome.

Later, Heise et al., U.S. Pat. No. 3,861,888, disclosed a method which adds $CO_2$ to an argon-oxygen mixture to form a three-gas component mixture for decarburizing metals.

It now has been found, in accordance with the invention, that argon can be completely replaced by carbon dioxide and a two-gas component mixture used to effect decarburization. Additionally, it has been found that the varying stages of decarburization cannot properly be treated equally as one single process. Each stage of decarburization is differently affected by many variables including the original carbon content of the molten metal, oxygen flow rate, carbon dioxide flow rate, furnace condition, temperature of the injection gases, bath temperature and aim temperature of the melt. By understanding the effect of the many variables on the different stages of decarburization, it is possible to improve the carbon removal efficiency in decarburization of molten metals and alloys.

OBJECTS OF THE INVENTION

Accordingly, it is an object of the invention to improve the carbon removal efficiency in decarburization of molten metals and alloys.

It is another object of the invention to employ a two-gas component mixture during decarburization of molten metals and alloys.

It is a further object of the invention to employ the two-gas component mixture especially during decarburization of molten metals and alloys with high carbon content.

These and other objects of the invention will be readily apparent from the following description and claims.

SUMMARY OF THE INVENTION

The objects listed above, and others which will be readily apparent to those skilled in the art, are achieved by the present invention.

In one aspect, the present invention is a process for decarburizing molten metal or ferro-alloys comprising in a first stage, adjusting the temperature of a molten metal or ferro-alloys bath to a desired operating range, in a second stage, reducing the carbon content of the molten bath to a predetermined value corresponding approximately to the carbon content of the bath in equilibrium with CO at a partial pressure of 1 atm and at a temperature within said desired operating range, and in a third stage, further reducing the carbon content of the bath from said predetermined value to substantially the desired carbon content, wherein at least during the first stage, a gas mixture comprising oxygen and carbon dioxide is introduced by subsurface injection into said molten bath, and during the second and third stages, a mixture comprising oxygen and an inert gas selected from the group consisting of argon, xenon, neon, helium and nitrogen is introduced into said molten bath.

DESCRIPTION OF CERTAIN PREFERRED EMBODIMENTS

Figure 1:
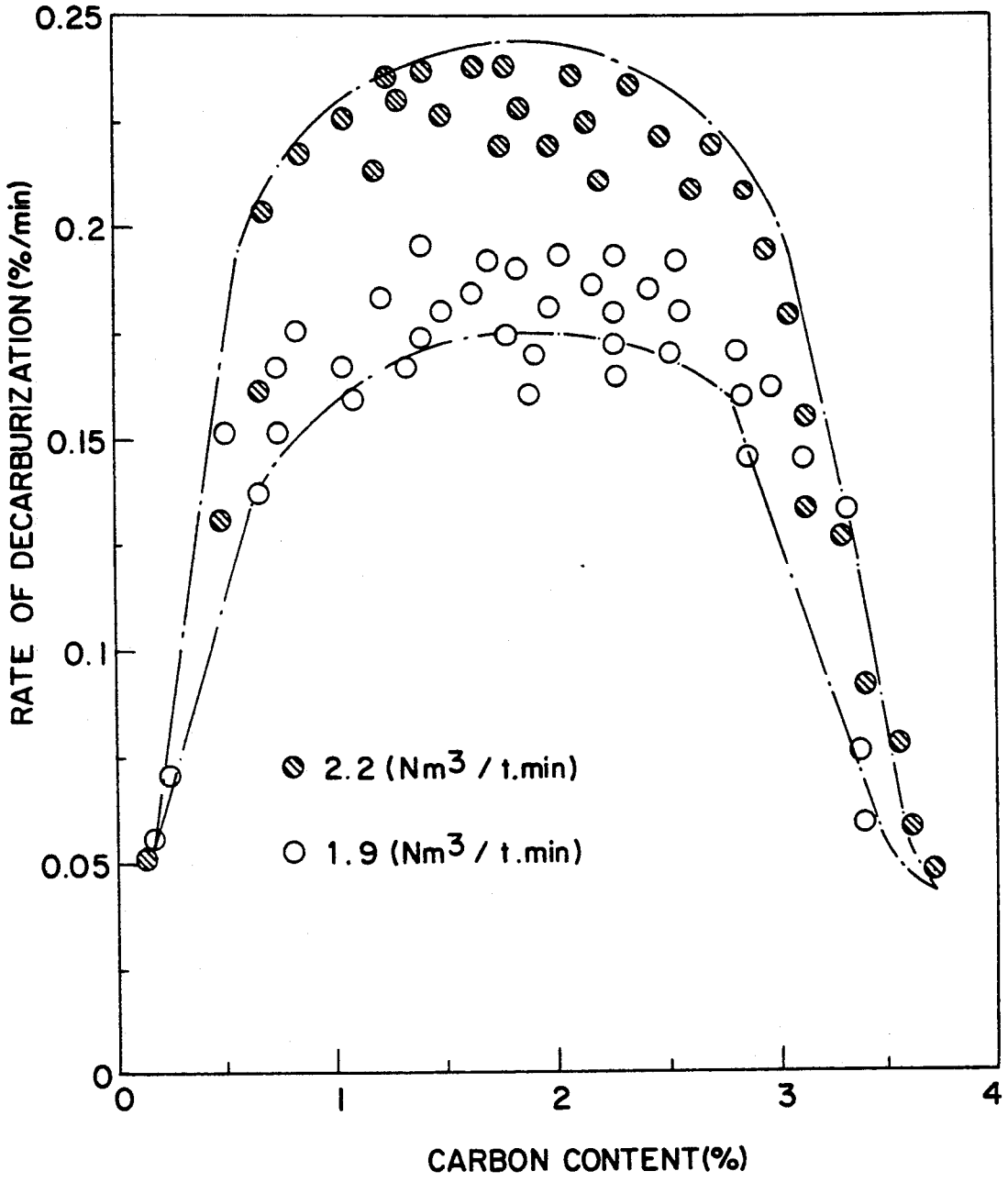
FIG. 1 compares the rate of decarburization with carbon content and indicates that there are varying stages in the decarburization process.

The term "decarburization" refers to the lowering of the carbon content of molten metals or alloys from any given level to any desired lower level. There are varying stages of decarburization as shown in FIG. 1, taken from *The Principles of Iron & Steelmaking*, Prof. Qo Ying, Beijing University, pp. 155. Specifically, decarburization is generally broken into three stages. The first stage is where the carbon content of the metal or alloy is highest, the second stage is where the carbon content is intermediate in amount and the third stage is where the carbon content of the metal or alloy is lowest.

In one respect, the present invention relates to the use of a two-gas component mixture, consisting only of oxygen and carbon dioxide, in decarburizing molten metals or alloys. In particular, the two-gas component mixture is used at least in the first stage of decarburization. In that stage, the temperature of the molten bath is between 1,400° and 2,500° C., preferably between 1,400° and 1,700° C. The practice of using a two-gas component mixture is viable in any reactor vessel, and particularly in an "AOD" vessel.

In the prior art, it has been assumed that the rate of decarburization is affected mainly by the flow rate of the oxidizing gas used in the decarburization process. The present inventors have discovered that, contrary to what has been thought, the rate of decarburization is affected by many variables in addition to the flow rate of the oxidizing gas. Some of these additional variables include the original carbon content of the metal or alloys, oxygen flow rate, carbon dioxide flow rate, the furnace condition, heat size, temperature of the injection gases, bath temperature and aim temperature of the melt. In fact, contrary to what has been thought, under certain circumstances the rate of decarburization is not affected by the flow rate of oxidizing gas. In particular, at later stages of decarburization, the influence of the flow rate of oxidizing gas on rate of decarburization is at best very limited. Instead, at the later stages, the rate of decarburization is primarily controlled by the rate of mass transfer of carbon.

Figure 2:
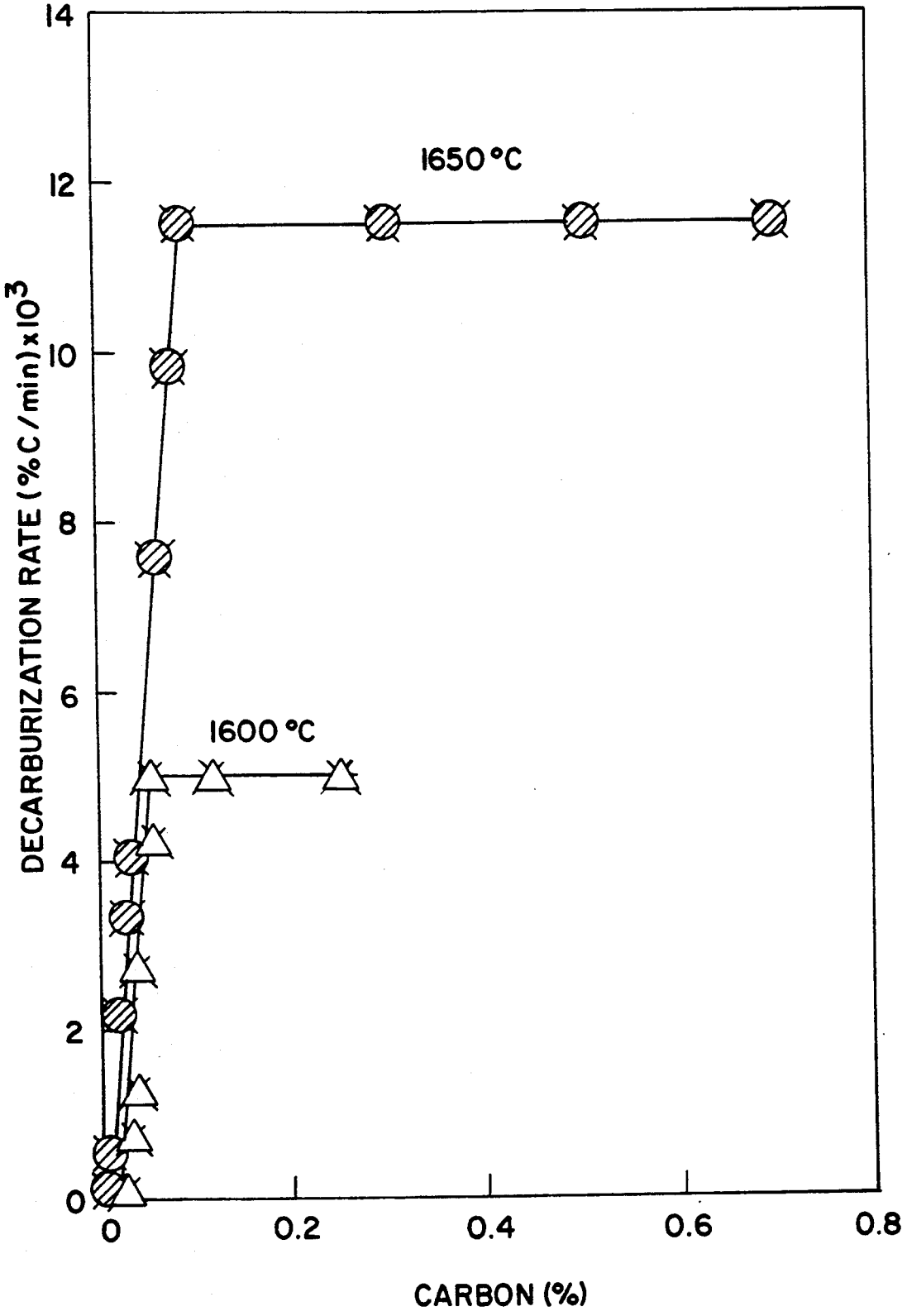
FIG. 2 shows the effect of temperature on the rate of decarburization.

That temperature can have an affect on the rate of decarburization is shown, for example, in FIG. 2. Additionally, furnace condition (including the size, geometry and wear of the vessel) and flow rate of the injection gases can have a significant affect. For example, an excessively high flow rate of injection gases may cause abnormal refractory wear in the region across from the injection tuyeres.

Also, the higher the original carbon content, generally the faster the rate of decarburization.

Similarly, up to a critical temperature, the warmer the $CO_2$ that is injected, and the higher the bath temperature, the faster the rate of decarburization.

With respect to the aim temperature for any particular stage, the higher the aim temperature, the lower the rate of decarburization attained to reach that aim.

From this it can be seen that the prior art failed to accurately account for many variables which affect the rate of decarburization. For example, according to the prior art, when carbon dioxide ($CO_2$) is added to a mixture of oxygen ($O_2$) and argon (Ar), the following equations were written:

$$F_{CO2}=[F_I((P/(1-P))-2XF_{02}] \quad \text{Eq. 1 and}$$

$$t=\frac{(322)(C_i-C_f)/X[0.4X+1.29(1-X)+1.24]-T_f+T_i}{[1.24(F_T-F_I)+Z_IF_I]/W+K_r} \quad \text{Eq. 2}$$

where $F_{CO2}$ is the flow rate of $CO_2$ (cfm);

$F_I$ is the flow rate of the inert gas argon (cfm);

P is the equilibrium partial pressure of CO for the particular bath temperature and carbon content of the molten steel (atmospheres);

X is the carbon removal efficiency in the absence of $CO_2$;

$F_{02}$ is the flow rate of $O_2$(cfm);

$C_i$ is carbon content of the melt at the start of the blow (percent);

$C_f$ is carbon content of the melt at the end of the blow (percent);

W is total weight of molten metal (tons);

t is blowing time (minutes); and $K_r$ is the measured heat loss coefficient of the vessel (° F/min).

Equation 1 originated from the following equation:

$$P=\frac{F_{CO2}+2XF_{O2}}{F_I+F_{CO2}+2XF_{O2}} \quad \text{Eq. 3}$$

The assumption made in the prior art to reach this equation 3 was that ($F_{CO2}+2XF_{02}$) represented the production rate of carbon monoxide (CO) gas and that $F_I+F_{CO2}+2XF_{02}$ represented the flow rate of total gases. However, it now has been found that the production rate of CO gas which is similar to the rate of decarburization, is mainly controlled by the rate of mass transfer of carbon, and not by the flow rate of oxidizing gas. This is especially true when the original carbon content of the metal or alloy is less than 0.25% (low). Accordingly, since equation 3 is in error, equation 1, derived therefrom and used in the prior art, does not accurately reflect the physical phenomenon which is actually occurring.

Similar misunderstandings appear in equation 2 which originated from the following equation:

$$F_{CO2}=2(F_T-F_I)-\frac{644(C_i-C_f)W}{Xt} \quad \text{Eq. 4}$$

The last term in Equation 4 leads to the following expression:

$$\frac{(C_i-C_f)}{t}=644XWF_{O2} \quad \text{Eq. 5}$$

In equations 4 and 5, $F_{CO2}$, $F_I$, X, W, $F_{02}$, $C_i$, $C_f$ and t are as defined above; and $F_T$ is total gas flow rate for the system (cfm).

The left side of equation 5 is the average rate of decarburization. However, it now has been found that the average rate of decarburization, much like the production rate of CO gas, is not proportional to the flow rate of oxidizing ga when the original carbon content of the metal or alloy is low. Accordingly, equation 5 is not accurate when the carbon content is low (for example, less than 0.25%).

Further, in accordance with the invention, it has been found that the use of a two-gas component mixture of $O_2$ and $CO_2$ improves the carbon removal efficiency in the decarburization of a molten metal or alloy. In particular, this two-gas component mixture best improves the carbon removal efficiency (rate of decarburization) at high carbon levels of the molten metal or alloy. Specifically, in a preferred embodiment, the two-gas component mixture is used in a molten bath where the carbon content is greater than 0.25%.

In one preferred embodiment, the $CO_2$ is preheated, especially to a temperature between about 140° and 500° F. The preheated $CO_2$ allows for the formation of an "oxide mushroom". This oxide mushroom protects the tuyere from direct contact with the molten bath and helps to diffuse the gas as it is injected into the molten bath. The diffusion action protects the back wall of the vessel from undue erosion by dispersing said gases spherically from the tuyere.

THE FIRST STAGE

Using the two-gas component mixture in the first stage of a decarburization process when the carbon content is highest, the rate of decarburization can be described as:

$$R_{02}=K_{02}F_{02} \quad \text{Eq. 6}$$

and $$R_{CO2}=K_{CO2}F_{CO2} \quad \text{Eq. 7}$$

where $R_{02}$ is the rate of mass transfer of carbon by oxygen;

$R_{CO2}$ is the rate of mass transfer of carbon by carbon dioxide;

$K_{02}$ is the mass transfer coefficient of oxygen;

$K_{CO2}$ is the mass transfer coefficient of carbon dioxide;

$F_{02}$ is the flow rate of oxygen; and $F_{CO2}$ is the flow rate of carbon dioxide.

For $O_2$ and $CO_2$, every 11.2 $Nm^3$ gas can oxidize 12 Kg carbon. Therefore, every 1 $Nm^3$ gas can oxide 12/11.2 or 1.072 Kg carbon. (The efficiency of $O_2$ will be higher than that of $CO_2$ in decarburization.) Generally, the maximum flow rate for oxygen and argon is 1000 SCFH/ton. In accordance with the present invention, the same flow rate for $CO_2$ should be used as was conventionally used for argon. In fact, due to a slight $CO_2$ dissociation, the total amount of oxygen for decarburization can actually be reduced, if desired, by as much as about 12%. In a preferred embodiment, the oxygen to carbon dioxide flowrate ratio is between about 2.5:1 to about 3.5:1.

Next, assuming that $n_{02}$ and $n_{CO2}$ represent the efficiency of $O_2$ and $CO_2$ in decarburization, then $K_{02}$ and $K_{CO2}$ (defined above) can be described as:

$$K_{02}=n_{02}\times 1.072\times 100/W \quad \text{Eq. 8}$$

and $$K_{CO2}=n_{CO2}\times 1.072\times 100/W \quad \text{Eq. 9}$$

where

W is the total weight of molten metal (Kg).

Of course, the following equation can be written:

$$R_g=R_{02}+R_{CO2} \quad \text{Eq. 10}$$

where $R_{02}$ and $R_{CO2}$ are as defined above; and $R_g$ represents the rate of decarburization in the first stage.

Since the rate of decarburization changes with the change of carbon content, it has been found that:

$$R_g=(n_{02}F_{02}+n_{CO2}F_{CO2})(1.072)(100/W) \quad \text{Eq. 11}$$

(Equation 11 combines equations 6–10 )

THE SECOND AND THIRD STAGES

In the second and third stages, the rate of decarburization is controlled mainly by the rate of mass transfer of carbon in the liquid phase. It can be described as follows:

$$R_L=(F/V)K_m(C_i-C_f)=(1/h)K_m(C_i-C_f) \quad \text{Eq. 12}$$

where $C_i$ and $C_f$ are as described above;

$R_L$ is rate of mass transfer of carbon in the liquid phase (C%/hr);

F is the melt surface area ($cm^2$);

V is the volume of molten metal ($cm^3$);

$K_M$ is the mass transfer coefficient (cm/hr); and h is the height of the molten metal.

The average rate of decarburization from the first stage to the third stage can then be described as follows:

$$R_{total}=R_g+n_LR_L+a \quad \text{Eq. 13}$$

where $R_{total}$ is the average rate of decarburization;

a is an adjusting value which reflects the correlation between $R_g$ and $R_L$;

$R_g$ is the rate of mass transfer of carbon in the gas phase (C%/hr.);

$R_L$ is the rate of mass transfer of carbon in the liquid phase (C%/hr.); and $n_L$ is an efficiency factor for the rate of decarburization at the free surface of the molten metal.

Combining equations 11, 12 and 13, the average rate of decarburization can be expressed as:

$$R_{total} = 1.072\frac{100}{W}(n_{O2}F_{O2} + n_{CO2}F_{CO2}) + (1/h)\,n_L\,K_m\,(C_i - C_f) + a \quad \text{Eq. 14}$$

or $$R_{total} = 1.072\frac{100}{W}(n_{O2}F_{O2} + n_{CO2}F_{cO2}) + (1/h)\,n_L\,K_m\,C_i - ((1/h)\,K_m\,n_L\,C_f - a) \quad \text{Eq. 15}$$

Figure 7:
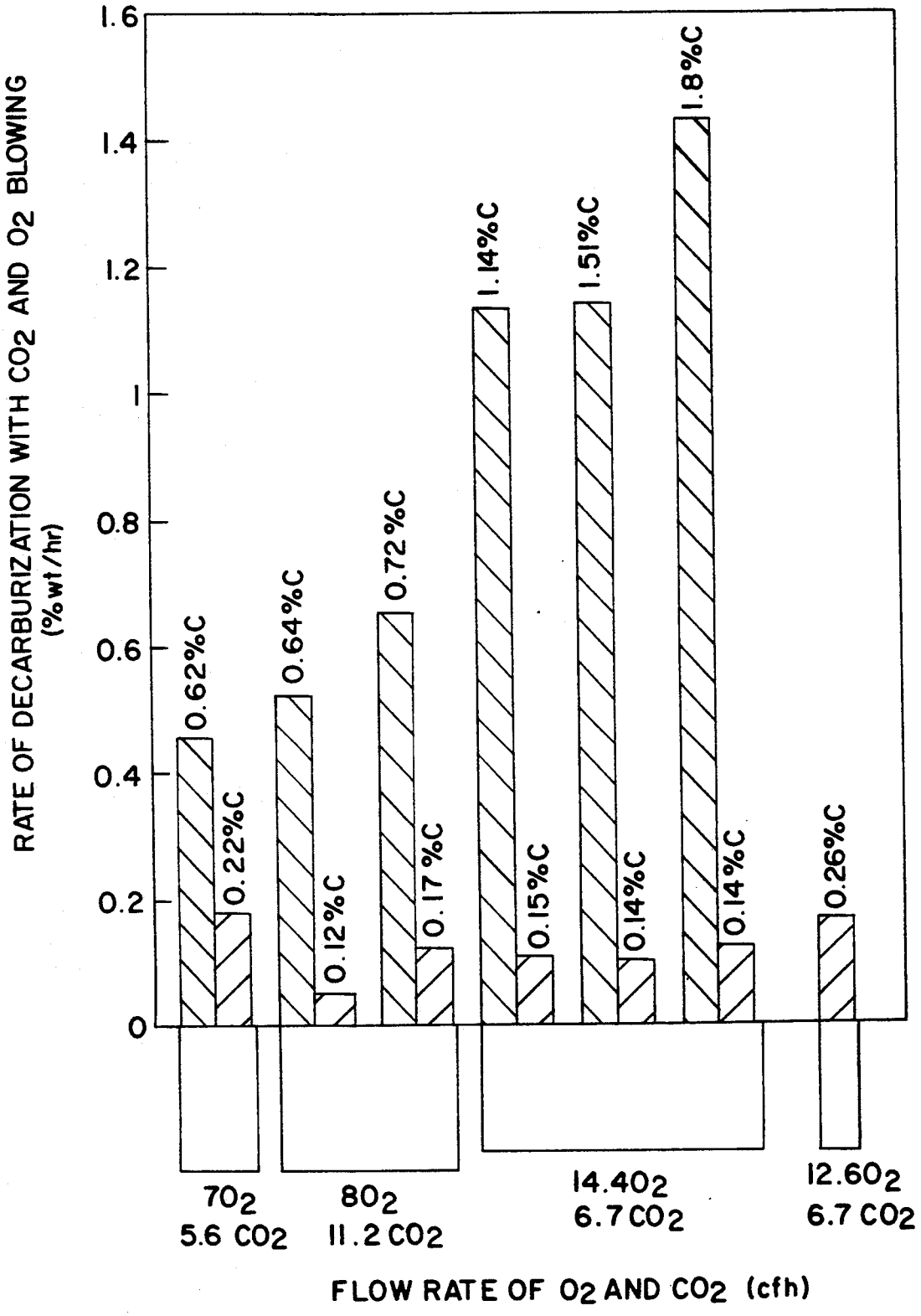
FIG. 7 shows some results of $0_2$ and $CO_2$ decarburization.

The above equations represent a more accurate general equation than has been used in the past and is appropriately more suitable for industry. The results of decarburization using a mixture of $CO_2$ and $O_2$ are shown in FIG. 7.

For the decarburization reaction using $CO_2$ and $O_2$ gas mixture, two regions have been defined according to the initial carbon content as follows:

1) High Carbon Range (C>0.25%) and

2) Low Carbon Range (C<0.25%).

In the high carbon range, the rate of decarburization analysis can be described by:

$$R_{high\ CO2+02}=0.45C_i+0.05\,F_{02}+0.01F_{CO2}-0.25 \quad \text{Eq. 16}$$

Figure 3:
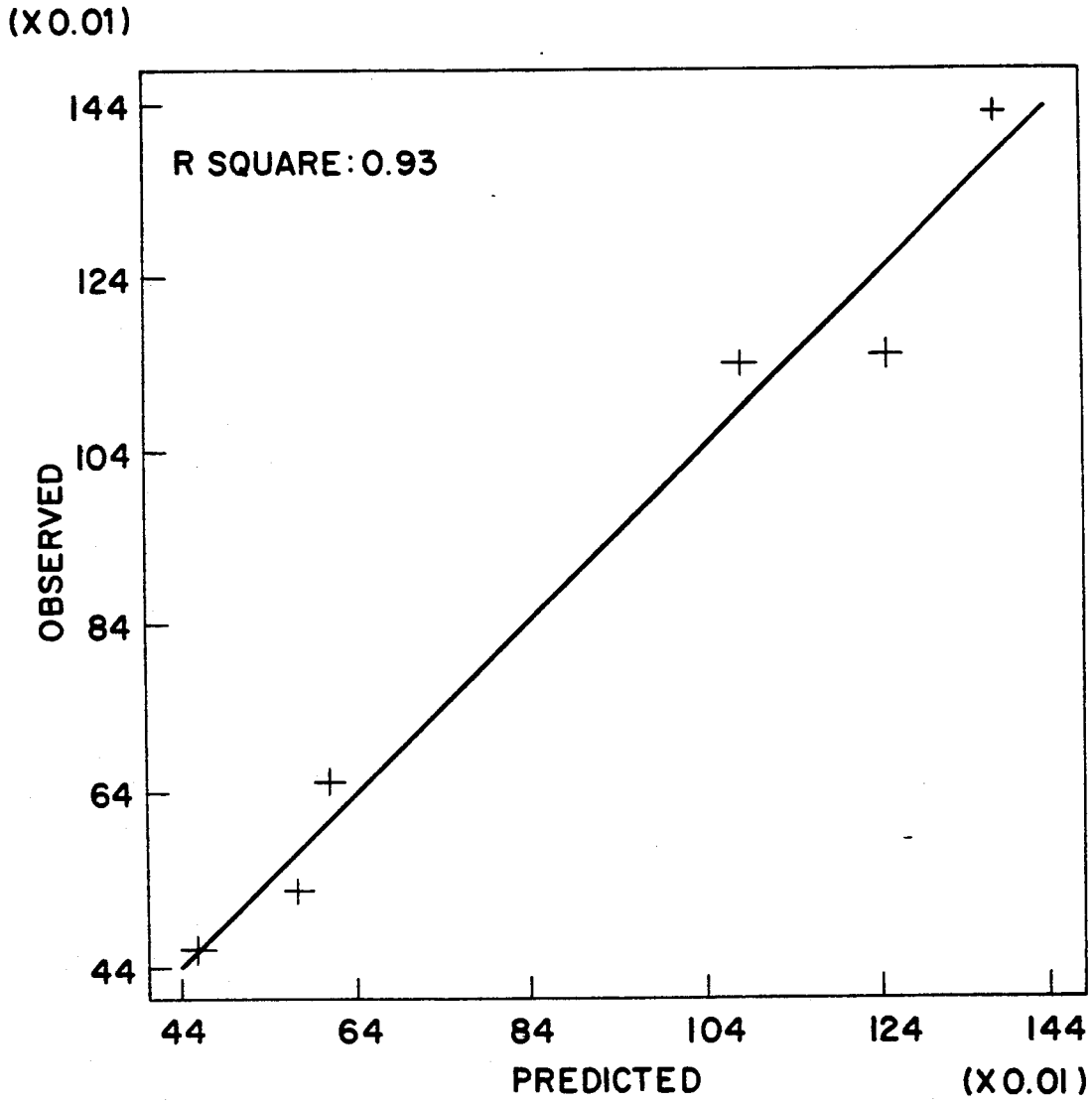
FIG. 3 plots the observed value against the predicted value from the equation $$R_{highCO2+02}=0.45C_i+0.05_{F02}+0.01F_{CO2}-0.25$$

The R square value equals 0.93 for the above equation, indicating that the equation is very accurate, and the observed value versus the predicted value by the above equation is shown in FIG. 3.

In the low carbon range, the rate of decarburization by statistical analysis can be described by:

$$R_{LOW\ CO2+02}=1.1\ C_i+0.002F_{02}-0.1 \qquad \text{Eq. 17}$$

Figure 4:
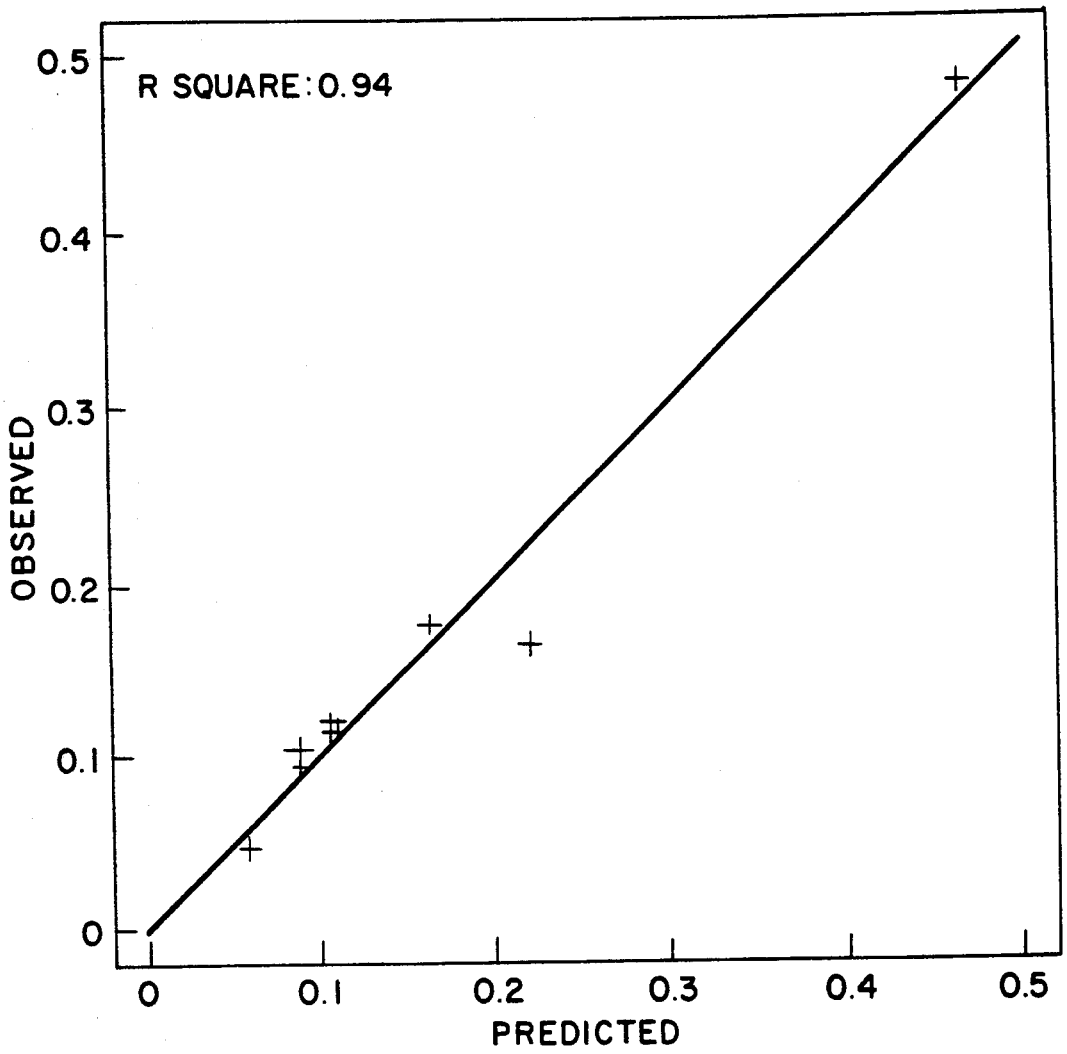
FIG. 4 plots the observed value against the predicted value from the equation $$R_{1OWCO2+02}=1.1C_i+0.002F_{02}-0.1$$

The R square value equals 0.94 for the above equation, and the observed value versus the predicted value by the above equation is shown in FIG. 4.

Using these equations, it has been observed that the influence on the rate of decarburization by the flow rate of oxidizing gas decreases as the initial carbon content decreases. These equations support the conclusion that the factor controlling the rate of decarburization is not the rate of supply of oxidizing gas but the initial carbon content.

Thus it can be seen that the rate of decarburization has a relationship with the initial carbon content of the melt. The influence of carbon content on the rate of decarburization cannot be ignored in a general equation which includes all three stages of the "AOD" refining process. General equations 14 and 15 include the influence of carbon content, and equations 16 and 17 are even more precise since they are appropriate for a specific carbon range/stage of the decarburization process.

The following equations were also developed to represent decarburization using only oxygen and argon. For the high initial carbon range:

$$R_{high\ 02+Ar}=(0.68)C_i+(0.03)F_{02}+(0.017)F_{Ar}-4.7 \qquad \text{Eq. 18}$$

Figure 5:
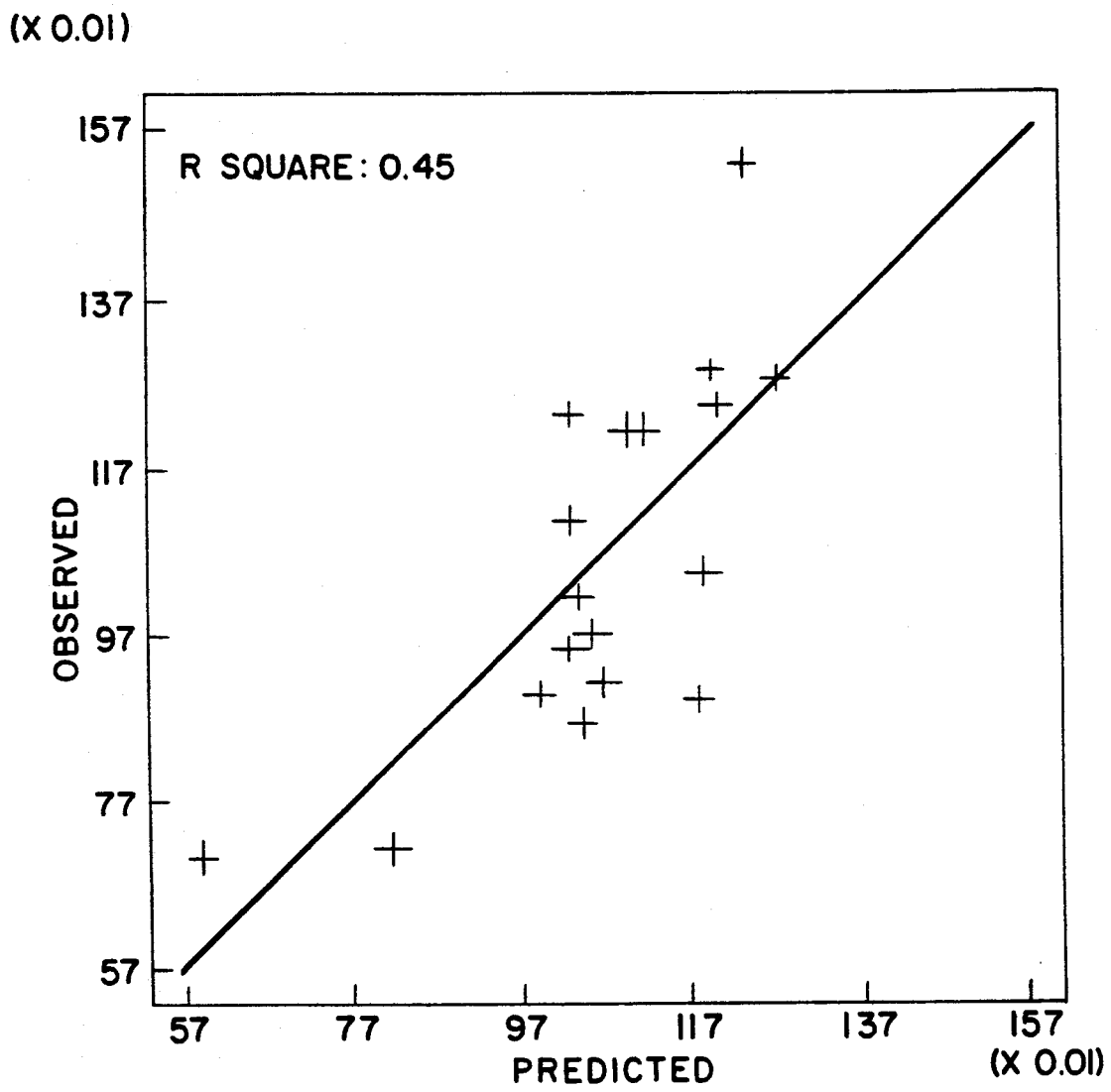
FIG. 5 plots the observed value against the predicted value from the equation $$R_{high02+Ar}=0.68C_i+0.03F_{02}+0.017\ F_{Ar}-4.7$$
Figure 8:
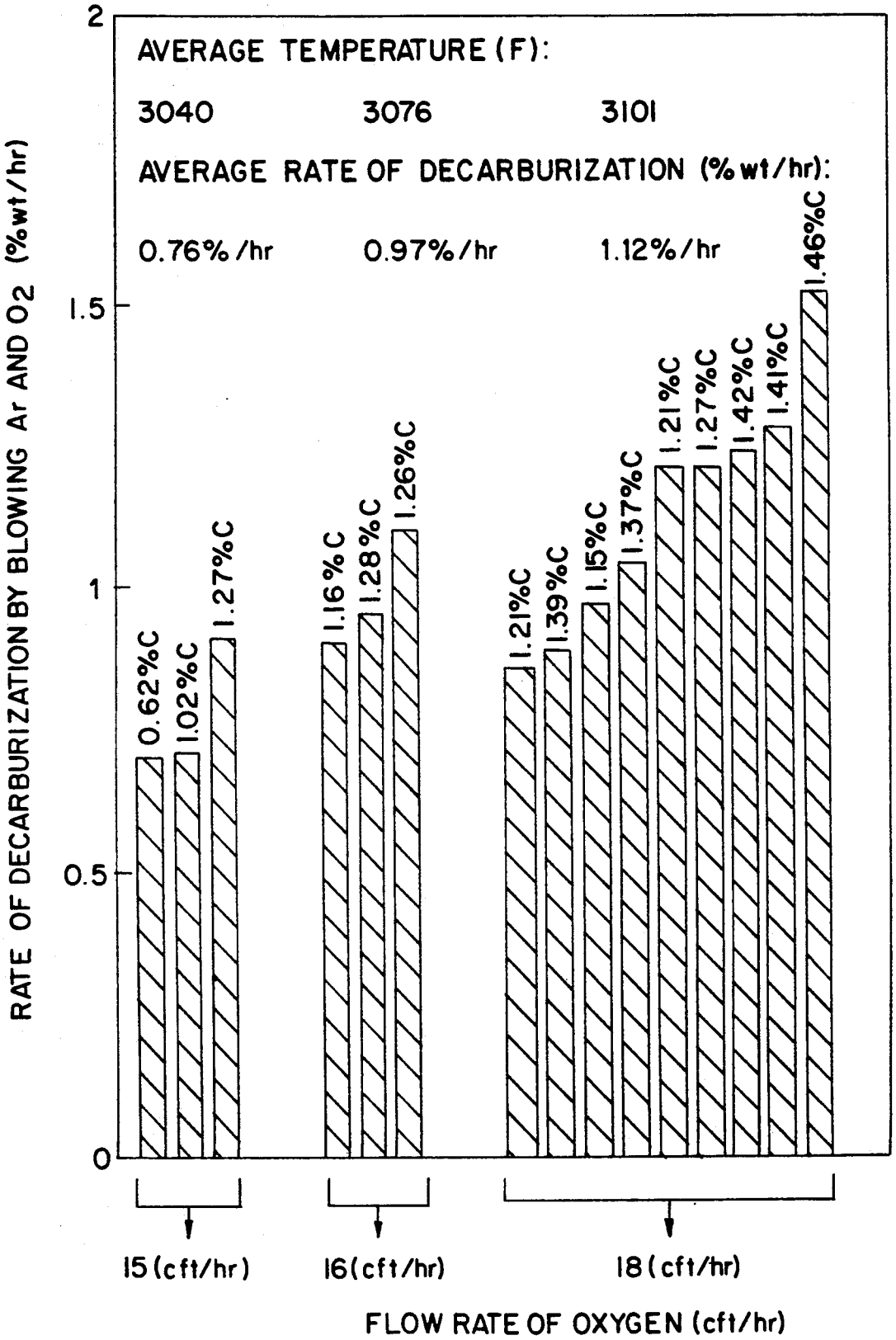
FIG. 8 shows some results of $O_2$ and Ar decarburization.

The results of decarburization with (Ar and $O_2$) are shown in FIG. 8. The R square value for the above equation is about 0.45 and the observed value versus the predicted value by the above equation is shown in FIG. 5.

In the low carbon region:

$$R_{LOW\ 02+Ar}=0.72\ C_i+0.01\ F_{02}+0.01\ F_{Ar}-1.7 \qquad \text{Eq. 19}$$

Figure 6:
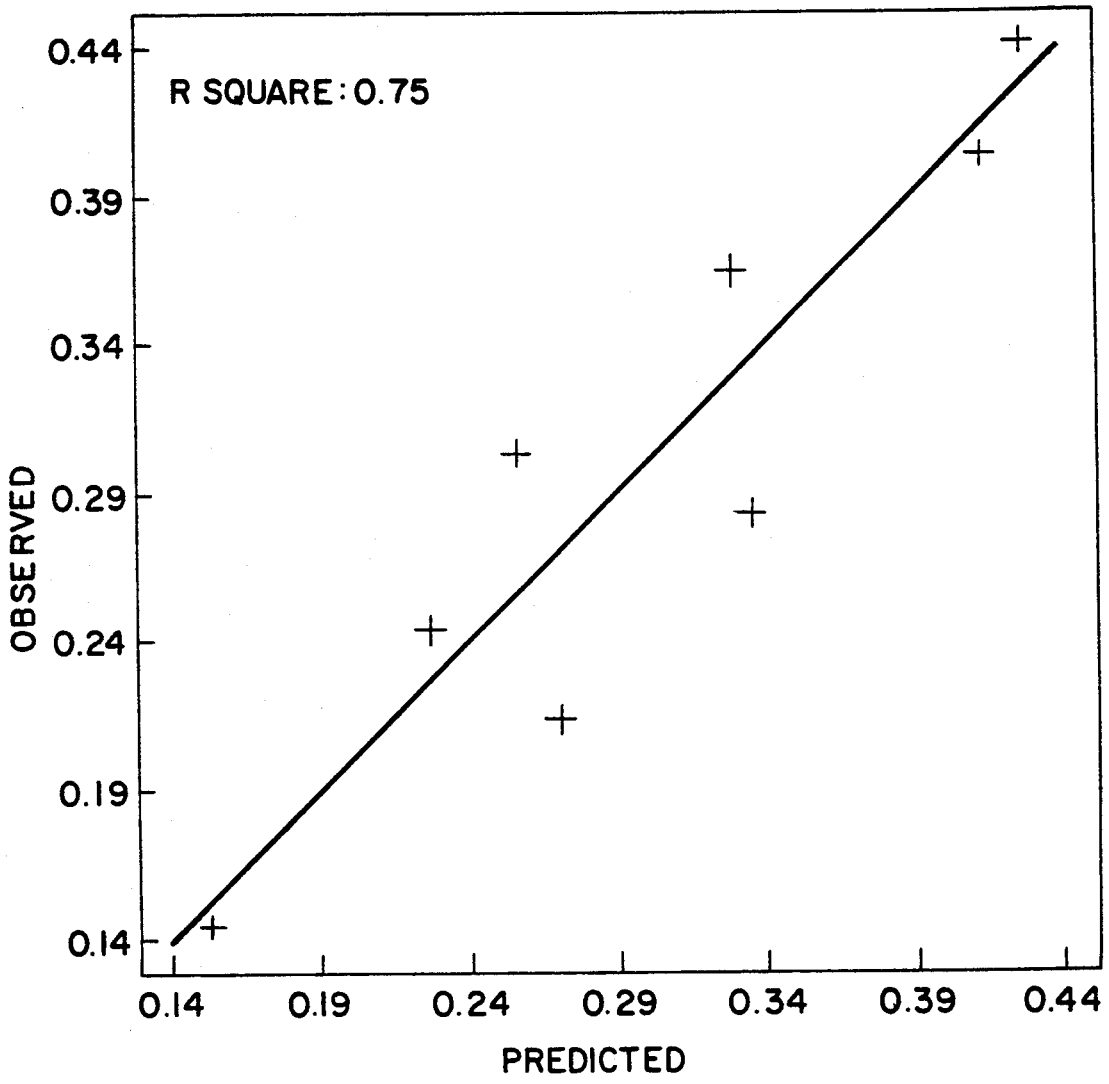
FIG. 6 plots the observed value against the predicted value from the equation $$R_{LOW02+Ar}=0.72C_i+0.01F_{02}+0.01F_{Ar}-1.7$$

The R square value for the above equation is 0.75, and the observed value versus the predicted value by the above equation is shown in FIG. 6.

If one compares equations 15 and 17, the results show that at the high carbon range the rate of decarburization was higher when an $O_2$ and $CO_2$ mixture was used than when an $O_2$ and Ar mixture was used. In the low carbon range, if one compares equations 16 and 18, the results show that the rate of decarburization was higher when $O_2$ and Ar mixture was used than when an $O_2$ and $CO_2$ mixture was used. Hence, it can be concluded that the use of $CO_2$ is more efficient in the high carbon region than in the low carbon region.

The terms and expressions which have been employed are used as terms of description and not of limitation, and there is no intention in the use of such terms or expressions of excluding any equivalents of the features shown and described or portions thereof, its being recognized that various modifications are possible within the scope of the invention.

We claim:

1. A process for decarburizing molten metal or ferro-alloys, comprising:

in a first phase, adjusting the temperature of a molten metal or ferro-alloys bath to a desired operating range, in a second phase, reducing the carbon content of the molten bath to a value correspond approximately to the carbon content of the bath in equilibrium with CO at a partial pressure of 1 atm and at a temperature within said desired operating range, and in a third phase, further reducing the carbon content of the bath from said value to substantially the desired carbon content, wherein during the first phase, a gas mixture comprising oxygen and carbon dioxide is introduced by subsurface injection into said molten bath, and during the second and third phases, a mixture comprising oxygen and an inert gas selected from the group consisting of argon, xenon, neon, helium and nitrogen is introduced in said molten bath, and wherein the carbon dioxide is preheated before introduction by subsurface injection.

2. A process according to claim 1, wherein the gas mixture is introduced in the first phase at a flowrate ratio of between about 2.5:1 to about 3.5:1 oxygen to carbon dioxide.

3. A process according to claim 1, wherein the injection of the gas mixture is through a tuyere traversing the refractory lining of a vessel containing the molten bath, and wherein the carbon dioxide gas is preheated to a temperature between 140° and 500° F.

4. A process according to claim 1, wherein the carbon content in the molten bath before starting injection of the gas mixture is greater than 0.25%.

5. A process according to claim 1, wherein the temperature of the molten bath in the first phase is between 1,400° and 2,500° C.

6. A process according to claim 5, wherein the temperature of the molten bath is between 1,400° and 1,700° C.

7. A process according to claim 1, wherein the molten metal is selected from the group consisting of stainless steel, carbon steel, low carbon steel, iron, nickel and cobalt based alloys.

8. A process according to claim 1, wherein the inert gas is argon.

* * * * *